US009643427B2

(12) United States Patent
Franck

(10) Patent No.: US 9,643,427 B2
(45) Date of Patent: May 9, 2017

(54) INK-JET PRINTER AND METHOD FOR OPERATING AN INK-JET PRINTER

(71) Applicant: Jan Franck, Weidenberg (DE)

(72) Inventor: Jan Franck, Weidenberg (DE)

( * ) Notice: Subject to any disclaimer, the term of this patent is extended or adjusted under 35 U.S.C. 154(b) by 0 days.

(21) Appl. No.: 15/107,556

(22) PCT Filed: Dec. 23, 2014

(86) PCT No.: PCT/IB2014/002866
§ 371 (c)(1),
(2) Date: Jun. 23, 2016

(87) PCT Pub. No.: WO2015/097535
PCT Pub. Date: Jul. 2, 2015

(65) Prior Publication Data

US 2016/0325555 A1 Nov. 10, 2016

(30) Foreign Application Priority Data

Dec. 23, 2013 (DE) ..... 10 2013 021 882

(51) Int. Cl.
*B41J 2/21* (2006.01)
*B41J 2/205* (2006.01)

(52) U.S. Cl.
CPC ..... *B41J 2/2132* (2013.01); *B41J 2/2054* (2013.01); *B41J 2/21* (2013.01); *B41J 2002/2058* (2013.01); *B41J 2202/06* (2013.01)

(58) Field of Classification Search
CPC . B41J 2/2054; B41J 2/21; B41J 2/2132; B41J 29/393; B41J 2002/06; B41J 2002/2058
See application file for complete search history.

(56) References Cited

U.S. PATENT DOCUMENTS 6,158,858 A 12/2000 Fujiike et al.
6,234,602 B1 * 5/2001 Soto ..... B41J 29/393 347/19
8,824,014 B1 * 9/2014 Robinson ..... H04N 1/52 358/3.06

FOREIGN PATENT DOCUMENTS

EP 0124190 7/1984
EP 0899937 3/1999
(Continued)

*Primary Examiner* — Anh T. N. Vo
(74) *Attorney, Agent, or Firm* — Pandiscio & Pandiscio

(57) ABSTRACT

The invention is focusing on an inkjet printer as well as on a method for operating an inkjet printer, in which for at least one color at least two inks of the of the same color, but of varying color intensity are used, namely one ink of a lighter color intensity $J_h$ and an ink of a darker color intensity $J_d$, where preferably to following applies: $J_d=2^x*J_h$, with x for example being 2, 3 or 4. Then $2^x$ is in these case $2^2=4$, or $2^3=8$, or $2^4=16$; whereat several ink drops are printed on one pixel on top of one another in quick succession, namely 0 . . . $(2^x-1)$ ink drops so that with the darker ink $2^x$ brightness levels can be accomplished, and with the lighter ink likewise $2^x$ brightness levels, what from altogether $2^x*2^x=2^{2x}$ different brightness levels are resulting; and where the individual drops unite together during their flight or do not come loose from each other, resulting in only one single color drop per pixel on the printing substrate.

19 Claims, 2 Drawing Sheets

(56) References Cited

FOREIGN PATENT DOCUMENTS

| | | |
|---|---|---|
| EP | 1078770 | 2/2001 |
| EP | 1312653 | 5/2003 |
| EP | 1780027 | 5/2007 |

* cited by examiner

INK-JET PRINTER AND METHOD FOR OPERATING AN INK-JET PRINTER

REFERENCE TO PENDING PRIOR PATENT APPLICATIONS

This patent application claims benefit of International (PCT) Patent Application No. PCT/IB2014/002866, filed Dec. 23, 2014 by Jan Franck for INK-JET PRINTER AND METHOD FOR OPERATING AN INK-JET PRINTER, which claims benefit of German Patent Application No. DE 10 2013 021 882.9, filed Dec. 23, 2013, which patent applications are hereby incorporated herein by reference.

FIELD OF THE INVENTION

The invention focuses on the operation of an inkjet printer so that thereby image files of a predetermined color depth of b bpc (bits per color), b∈N, can be printed out, whereat, as the case may be, the color depth signals specified in an image file are converted from the color system $F_1$, $F_2$, $F_3$, for example Red, Green, Blue, available here into color depth signals of the printing inks $D_1$, $D_2$, $D_3$, etc., for example Cyan, Magenta, Yellow, as well as Black, where applicable, available there so that in the process the resolution used for color depth of b bpc is surviving in the color depth signal referring to the printing color $D_\mu$, whereat for one or several, in particular all printing colors $D_\mu$, in each case at least two inks $T_{h,\mu}$, $T_{d,\mu}$ of the same color $D_\mu$, but of varying color intensity are used, namely at least one lighter ink $T_{h,\mu}$ of a lighter color intensity $J_{h,\mu}>0$, or even a colorless, brightening ink $T_{f,\mu}$ of a brightening, virtual color intensity $J_{f,\mu}<0$ and at least one darker ink $T_{d,\mu}$ of a darker color intensity $J_{d,\mu}$, whereat in case of a lighter, but not colorless ink $T_{h,\mu}$ the following applies:

$$J_{d,\mu}-n*J_{h,\mu}=0$$

and in case of a colorless ink $T_{f,\mu}$:

$$J_{d,\mu}+n*J_{f,\mu}=0$$

with n∈N, n≥2; and μ=1, 2, 3 . . . ; whereat on the area assigned to one pixel several drops of the same ink $T_{h,\mu}$, $T_{d,\mu}$ can be printed on top of one another, namely maximal (n−1) ink drops of the lighter ink $T_{h,\mu}$ and maximal (m−1) ink drops of the of the darker ink $T_{d,\mu}$ so that with the darker ink $T_{d,\mu}$ m brightness levels can be accomplished, namely 0 . . . ($m*J_{d,\mu}$), and with the lighter ink $T_{h,\mu}$ n brightness levels, namely 0 . . . ($n*J_{h,\mu}$), from what altogether (n*m) different brightness levels are resulting, namely 0 . . . $[(m-1)*J_{d,\mu}+(n-1)*J_{h,\mu})]$.

A printer applicable for this purpose comprises for one or several, in particular for all printing colors, so for example Cyan, Magenta, Yellow, as well as Black, where applicable, a) in each case two ink supply tanks for two printing inks of the same color, but of varying color intensity, namely at least one lighter ink $T_{h,\mu}$ of a lighter color intensity $J_{h,\mu}>0$, or even a colorless, brightening ink $T_{f,\mu}$ of a brightening, virtual color intensity $J_{f,\mu}<0$ and at least one darker ink $T_{d,\mu}$ of a darker color intensity $J_{d,\mu}$, whereat in case of a lighter ink the following applies:

$$J_{d,\mu}-n*J_{h,\mu}=0$$

and in case of a colorless ink $T_{f,\mu}$:

$$J_{d,\mu}+n*J_{f,\mu}=0$$

with n∈N, n≥2; as well as b) in each case two printing units, of which one is supplied from the ink supply tank for the lighter ink $T_{h,\mu}$, the other one however from the ink supply tank for the darker ink $T_{d,\mu}$.

BACKGROUND OF THE INVENTION

Thermal dye sublimation printers or photo printers for example have a resolution of 300 dpi and for example 255 different color intensities per pixel. Thereby very good image qualities can be generated, whereby absolutely no screening can be seen. This results from the fact that in thermal sublimation printing a dye of a waxy consistency is used. By high temperatures of ca. 300° C. or more the wax is transformed into a gaseous phase in which it can be vapor deposited. To do so in practice individual partial areas of a print head are heated in order to partially evaporate dyes from a carrier foil, which then are transferred onto the paper. On the basis of temperature the quantity of the dye to be transferred can be specified, and in this way the brightness or color intensity of the pixel concerned can be varied. As this is theoretically infinitely variable possible, a great color depth and color saturation can be generated; in practice in most cases discrete heating values are specified, for example 255 different heating values. Also individual pixels are not distinguishable. On the other hand however there are high investment and/or operating costs.

Compared with this are current ink printers or inkjet printers, for example with piezo print heads, indeed cheaper. Here the printing process is controlled either by individual electrostatic charging of a continuous inkjet, which then, depending on its electrostatic charge, can be deflected in a field (continuous inkjet method, CIJ), or by dispensing individual drops as required (drop-on-demand method, DOD). Such printers however master only 2 or 3 color intensities per each printing color. While this becomes hardly noticeable especially when printing out text or other black and white documents with a strong contrast between bright and dark, inkjet printers are less suitable for printout of color photographs. In order to be able to use them as photo printers anyway, it was already tried to improve the intrinsically unsatisfactory color rendering of inkjet printers by partitioning each individual pixel into a small screen of, for example, 4 times 4 smaller dots then followed by printing 0, 1, 2 . . . 15, 16 of those small screen dots, so one can then already—at a rather macroscopic inspection—distinguish 16 different color intensities. The problem however is that these smaller brightness screen dots of a pixel are indeed still perceived by the eye as dots or anyway as a visual disturbance. Even worse, in case of pixels of exactly the same color a then always repeating screen dot arrangement would lead to a so-called moiré effect, i.e., the microscopic structures are regularly repeating and thereby generating a clearly perceptible or even unmissable macroscopic pattern.

A method conforming to its genre for example is revealed in document EP 0 899 937 A2. There inks of the gray shades 0, 80, 130, and 255 are used whereat in a color intensity interval between 0 and 80 only inks with the gray values 0 and 80 are used proportionately, in a color intensity interval between 81 and 130 inks with the gray values 80 and 130 are used, and so forth. However it is relatively complicated here to arrive at the proportionate shares of two inks of different brightness values or respectively intensities starting from a color value of an image; that requires among other things matrix calculations, in particular computations by means of a so-called dithering matrix. For example when an ink of a color intensity of 130 is more intensive by the factor 1.625 against an ink having a color intensity of 80 so that the allocation of appropriate quantities in a drop turns out to be complex.

From these disadvantages of the described state of technology resulting is the problem initiating the invention to advance an ink or inkjet printer to such an extent, or to develop a printing method suitable for ink or inkjet printers so that thereby also such printers can be utilized as photo printers with an optimum of color depth.

SUMMARY OF THE INVENTION

The solution of this problem succeeds according to the teaching of the invention by following measures:

On the one hand at least two inks of the same color, but of different color intensity are used in each case for each printing color, so for example Cyan, Magenta, Yellow, namely an ink having a brighter color intensity $J_{h,\mu}$ and at least one ink with a darker color intensity $J_{d,\mu}$, in which in the ideal case the following exactly or with best-possible approximation applies:

$$J_{d,\mu}-2^x*J_{h,\mu}=0$$

Herein is x a natural number, thus a positive whole number like 2, 3, or 4; then $2^x$ is in these cases for example $2^2=4$, or $2^3=8$, or $2^4=16$.

Furthermore it is possible to print several ink drops onto one pixel, for example 0 . . . $(2^x-1)$ ink drops. This means, with the lighter ink $2^x$ brightness levels can be achieved, and with the darker ink for example also $2^x$ brightness levels. Then altogether thereof resulting are $2^x*2=2^{2x}$ different brightness levels. With x=2 for instance these are $2^4=16$ different color intensity steps, with x=3 these are $2^6=64$ different color intensity steps, and with x=4 one obtains $2^8=256$ different color intensity steps.

This can be accomplished inter alia by dispensing up to $2^x$ ink drops very quickly one after another.

Due to the high frequency of ink drops and due to the fact that the drops of the same ink allocated to one pixel originate from one and the same nozzle, the individual droplets do not separate from each other, but stay connected to each other by a thin strand of ink even during their flight through the air. In consequence of the surface tension or internal tension of such an ink strand the individual drops endeavor to contract and to unite together during their flight through the air. Therefore they impinge on the printing substrate as one single large drop.

Therefore neither drops separated from each other with a microstructure remain visible, nor a moiré-type macrostructure resulting thereof. Instead a high color resolution can be realized by this method without requiring substantial changes in the hardware, and without having a restless printed image resulting due to that method.

As furthermore not, for instance, 16 small dots have to be printed per pixel, which would require at least 4 print nozzles, but at the most only two, namely one ink drop of a dark color intensity, and one ink drop of a lighter color intensity, only 2 print nozzles per pixel are needed. Therefore the hardware complexity is reduced in comparison with the above-described conventional method.

If one wants to avoid the moiré effect at the state of the art, neighboring pixels of the same color intensity need to be printed in various ways, i.e. in fact the same number n of small dots are printed each time at these pixels with $0 \le n \le 16$, however they are always located at different positions so that a macroscopic regularity perceptible as moiré effect does not occur.

In addition the utilization of inks with uneven-numbered multiples of color intensity also implicates a greater computational effort, or even obstructs an exact, photorealistic image resolution.

All this entails in a multiplicity of computations, which has a negative impact on the achievable printing speed and/or on the obtainable color depth.

With the printing technique according to the invention at the one hand the computational effort is distinctly reduced and on the other hand the color depth and image quality are significantly improved. At the same time inter alia the control electronics for a printer according to the invention can be realized by far simpler and cheaper than in the state of the art solutions.

It has become evident that also printing with a colorless ink, so just with the pure solvent, has a brightening effect. This arises from the fact that the dye is "slurring" and so loses luminous power. One can assume in that case that the actually colorless ink would have a negative color intensity $J_{f,\mu}<0$ because of its brightening effect. For this case can be written:

$$J_{d,\mu}+2^x*J_{f,\mu}=0$$

The negative color intensity $J_{f,\mu}<0$ for instance can be adjusted by varying the drop size of the printing equipment, when necessary also by admixing a brightening, milky to white substance or white dye respectively.

An inkjet printer according to the invention for printing out image files with a specified color depth b bpc, b∈N, in photo quality comprises for one or several, in particular for all printing colors, so for example Cyan, Magenta, Yellow, as well as Black, where applicable, and/or other colors, in each case two ink supply tanks provided for two printing inks of the same color, but of different color intensity, namely for a lighter ink with a brighter color intensity $J_h$ und and for a darker ink with a darker color intensity $J_d$, where the following applies:

$$J_{d,\mu}-n*J_{h,\mu}=0$$

with n∈N, n≥2; as well as in each case two printing units provided, of which one is supplied from the ink supply tank for the lighter ink, the other one however from the ink supply tank for the darker ink. At that a printer according to the invention is designed so that n∈N, $n=2^x$, where the following applies:

$$J_{d,\mu}=2^x*J_{h,\mu},$$

where x∈N, can be x≥2, for example 2, 3, or 4; then $2^x$ is in these cases $2^2=4$, or $2^3=8$, or $2^4=16$; and whereat the control signals for a printing unit $E_{h,\mu}$ for the lighter ink $T_{h,\mu}$ are derived from the x lower value bits of the color depth signal referenced to the print colors $D_\mu$ used in such way that a number of drops of the lighter ink $T_{h,\mu}$ corresponding to the binary number in the x lower value bits are shot at frequent intervals in succession, and whereat the control signals for a printing unit $E_{d,\mu}$ for the darker ink $T_{d,\mu}$ are derived from not more than (b−x) higher value bits of the color depth signal referenced to the print colors $D_\mu$, while a number of drops of the darker ink $T_{d,\mu}$ corresponding to the binary number in the not more than (b−x) higher value bits are shot at frequent intervals in succession, however time-delayed by a time interval +τ, −τ corresponding to the physical distance +d, −d of both printing units $E_{h,\mu}$, $E_{d,\mu}$ in transfer direction of the substrate, and whereat for generating of an inkblot corresponding to the image information for one pixel on the substrate in each case only one single nozzle opening is provided at each printing unit.

In the case of a brightening colorless ink the negative value $J_{f,\mu}$ shall be formulated instead of $J_{h,\mu}$:

$$J_{d,\mu}+2^x*J_{f,\mu}=0$$

As in such case the printing of different drops on different areas of a pixel is omitted, in each case one single nozzle per pixel and print color and ink brightness suffices instead of, for instance, 16 as hitherto.

Since within the scope of the invention the method of dispensing of the individual ink drops does not matter, a differentiation between CIJ printers and DOD printer is not necessary. Both types of printers can be operated following the principle according to the invention.

The invention furthermore includes a data splitter that forwards the higher value, maximal (b−x) bits of the color depth signal of a pixel to the printing unit for the darker ink, lower value x bits of the color depth signal of the same pixel however to the printing unit for the lighter ink. Based on the brightness adjustment of the different inks according to the invention such data splitter can be constructed extremely simple.

For example a b=8 bit comprising color depth signal for one color in case of x=4 can be partitioned into two each time 4 bit comprising portions.

In the course of data splitting simply the entire data word or byte can be transmitted into a register and then each be overwritten there by zeros at the (b−x) higher value bits in order to make the remaining lower value bits of the printing unit available for the lighter ink. In such a case one eventually receives—right-aligned within the respective register respectively data word or byte—a binary number, which immediately can be interpreted as the desired number of drops of the respective—brighter—ink to be dispensed.

On the other hand—maybe at a different point in time, at which the pixel concerned is located exactly below the printing unit for the second for example darker ink—the entire data word or byte can be transmitted into a register and then each be overwritten there by zeros at the x lower value bits in order to make the remaining higher value bits of the printing unit available for the darker ink.

Thereupon preferentially also the higher value bits can be moved by x digits to the right so that eventually—right-aligned within the respective register respectively data word or byte—a binary number appears, which immediately can be interpreted as the desired number of drops of the respective—darker—ink to be dispensed.

Additional advantages provides a delay module, which is next in line to only one output of the splitter, not however to the other. Thereby can be accomplished that all print signals concerning both inks for one color and one pixel can be computed at a single point in time, for example when the—viewed in printing direction—forward printing unit shall print on one pixel; while the respective other printing unit for the same-color ink—however of different brightness—reaches that pixel at a later point in time so that the print signal allocated to that pixel and to that ink must be cached.

Since this method requires not just insignificant memory space, there is alternative to this the possibility of timewise splitting up computations of control signals for the printing unit for inks of the same color, but of different intensity and to carry them out for the lower-value x bits at a different point in time than the computations for the higher-value, maximal (b−x) bits. In such case it is possible—almost in real time—to carry out the computations assigned to one ink of a given color and brightness independently from computations for all the other inks.

The invention furthermore excels through color depth registers for entering the bits of the color depth signal of a pixel allocated to a printer unit. Of course a printer unit normally prints several pixels simultaneously, which then particularly are arranged in one row running crosswise to the feeding direction of the paper, or substrate, or of the print head. In such case the color depth register naturally expands into a type of register vector with a corresponding number of registers so that an individual register is allocated to each nozzle or each pixel respectively.

In the case of one darker and one lighter ink with an each time positive color intensity the spitted and into color depth registers inscribed fraction values of the original color depth signal can immediately or directly be used, namely as number for the drops of the respective ink to be dispensed in each case.

Different are things here with a brightening, in particular colorless ink: Here the total color intensity decreases with an Increasing number of dispensed drops. Therefore a slightly modified algorithm should be used here. In particular the number $D_{f,\mu}$ in the color depth sub register should be converted with the x lower value bits into a corrected value $\underline{D}_{f,\mu}$, for example according to the following formula:

$$\underline{D}_{f,\mu}:=2^x-D_{f,\mu}.$$

At the same time the number $D_{d,\mu}$ in the color depth sub register should be converted with the (b−x) higher value bits into a corrected value $\underline{D}_{d,\mu}$, for example according to the following formula:

$$\underline{D}_{d,\mu}:=D_{d,\mu}+1.$$

Here applies $$\begin{aligned} D_\mu &= 2^x * D_{d,\mu} + D_{f,\mu} = \\ &= 2^x * (D_{d,\mu} - 1) + 2^x - \underline{D}_{f,\mu}, = \\ &= 2^x * \underline{D}_{d,\mu} - \underline{D}_{f,\mu}; \end{aligned}$$

In consequence of this transformation now the corrected partial color intensities $\underline{D}_{d,\mu}$ and $\underline{D}_{f,\mu}$ enter into the total color intensity with opposite signs as this is also the case with a because of negative or virtually negative color intensity colorless ink in contrast to a darker, more intensively dyed ink, i.e., these corrected color values can directly be used for dispensing a corresponding number of drops of the respective ink.

Per pixel or per nozzle there is preferably in addition a component that generates each time a pressure pulse within a specified time pattern as long as the value in the color depth register allocated to a pixel or to a nozzle is greater than zero. The time pattern for this for example can be derived from a device-internally generated pulse sequence.

Preferably also another component exists in addition, which each time, decrements the value stored in a color depth register by one after a pressure pulse has been generated. For example, when the value previously stored in the register was a 1, then this will now be reduced to 0 and consequently no further pressure pulse will be given at the following pulse of the specified time pattern. When however the value stored in the color depth register is greater than 1, for example 7, then it will just be reduced to the value 6 and following this another pressure pulse will be generated, and so forth until the value has actually been decremented to 0. Such an arrangement makes it possible that each time exactly as many pressure pulses are emitted in direct succession as specified in the binary number in the x or (b−x) bits of the color depth register.

The principle according to the invention can be extended to three, four or even more inks per each color, which distinguish each other by different color intensity respectively brightness, preferably by $2^{x1}$, $2^{x2}$, $2^{x3}$, etc., with $x_1 \in N$, $x_2 \in N$, $x_3 \in N$; $x_1 \geq 1$, $x_2 \geq 1$, $x_3 \geq 1$. Thereby the equation:

$$x_1+x_2+x_3+\ldots=b$$

should be fulfilled.

If for example b=8, then this could be printed using three inks, in which $x_1=x_2=3$, corresponding to a lighter ink with a color intensity $J_1=J_0$, a medium ink with a color intensity $J_2=8*J_0$, and a darker ink with a color intensity $J_2=64*J_0$.

With four inks for example one could choose $x_1=x_2=x_3=2$, corresponding to a lighter ink with a color intensity $J_1=J_0$, a medium light ink with a color intensity $J_2=4*J_0$, a medium dark ink with a color intensity $J_3=16*J_0$, and a dark ink with a color intensity $J_4=64*J_0$.

The invention furthermore allows for advancement to the effect that the individual ink drops of the same color and same brightness to be printed on top of one another are dispensed in such quick succession that a previous drop has not jet completely come loose from the printing unit, when the following color drop per pixel is already dispensed so that the ink drops do not actually come apart from each other. In this way the drop size can be influenced, so to speak smaller drops are multiply "pumped into" a larger drop in order to enlarge that one accordingly. It has shown that thereof the ink quantity delivered per (smaller) drop does not or hardly vary so that the drop size and with it the quantity of dye can be controlled with good approximation proportionally or linear.

After all it corresponds to the teaching of the invention that a printing unit is used, which is capable of dispensing ink drops of various sizes, for example coded via a dual value. Thereby can be envisaged according to the invention that a dual value is passed on to the printing unit, which determines the size of the smaller drop, for example according to the following pattern:

00=0 drops
01=1 drop, small (=size 1-fold)
10=1 drop, medium (=size 2-fold)
11=1 drop, large (=size 3-fold)

As in such case the size of a smaller individual drop is variable, a portion of the information of a partial color value, for example both of its lowest-value bits, can be directly transmitted to the printing unit in order to let these lowest-value bits of a partial color intensity value have influence on the right drop size. Then the higher value bits of a partial color intensity value can be incorporated by repeated quickly succeeding dispensing of drops.

So for example a color intensity value of 1101=13=1+4*3 could be realized by one 1-fold size drop and four 3-fold size drops; thereby these individual drops should be dispensed in such quick succession that they cannot come loose from each other but cohere and reach the substrate as one single drop. As one can see, the specification of individual drop sizes can lead to a considerable reduction of the total number of small individual drops to be dispensed, for example for a partial color intensity value of 4 bit from 15 to perhaps 6, so to less than a half.

BRIEF DESCRIPTION OF THE DRAWINGS

Further characteristics, properties, advantages, and effects on the basis of the invention follow from the following description of a preferred embodiment of the invention as well as by reference to the drawing. Here shows.

DETAILED DESCRIPTION OF THE PREFERRED EMBODIMENT

Figure 2:
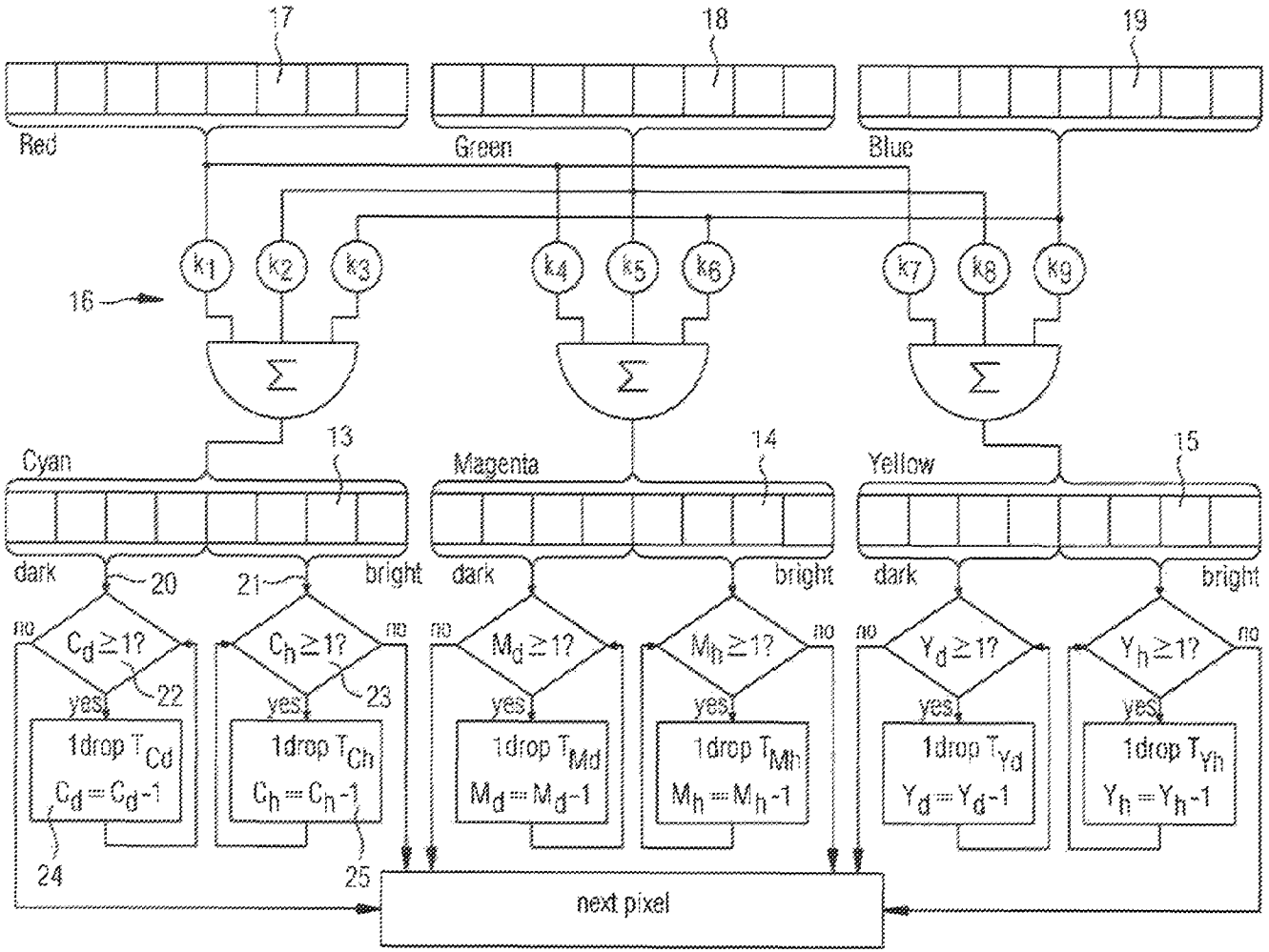

The representation according to FIG. 2 for example assumes the so-called "true color" format, where the color information stored in an image file within the scope of one single image point or pixel comprises a size of 24 bit, corresponding to 24 bpp (bits per pixel). The same includes the coefficients for the three colors Red (R), Green (G), and Blue (B), the so-called RGB color space, in which the respective coefficients can be between $0=2^0-1$ and $255=2^8-1$. Therefore are each time 8 bit allotted to each of the three colors, so in each case 8 bpc (bits per color).

These RGB color values frequently used with image files are not compatible with the printing colors Cyan (C), Magenta (M) and Yellow (Y) as well as perhaps Black frequently used with printers.

Therefore image files are first of all converted into a print format suitable for the printing colors used, for example into CMYK coefficients, where K stands Key, representing an additional operant.

There are several options for conversion. Multiplications for example with conversion factors $k_1 \ldots k_9$ can be performed as well as in each case a summation over three factors, so perhaps as follows:

$$C=k_1*R+k_2*G+k_3*B;$$

$$M=k_4*R+k_5*G+k_6*B;$$

$$Y=k_7*R+k_8*G+k_9*B;$$

At the one hand multiplications imply some computational effort; at the other hand also a normalization must take place, which becomes noticeable as division, or—incase such normalization is already factored in the conversion factors $k_1 \ldots k_9$—appears as multiplication with a decimal number with decimal point. In any case finally some rounding is necessary so that the computational effort is immense.

Therefore simpler conversion methods exist for obtaining CMY data with a color depth of 8 bpc from an Image file with 8 bpc RGB color values, for example by means of the following algorithm, where values indexed by 0 represent preliminary interim results that can subsequently be abolished respectively deleted or overwritten again:

$$C_0:=255-R,$$

$$M_0:=255-G,$$

$$Y_0:=255-B;$$

$$K_0:=\min(C_0,M_0,Y_0);$$

Then thereof the C, M, and Y values can be determined as follows:

$$C:=C_0-K_0,$$

$$M:=M_0-K_0,$$

$$Y:=Y_0-K_0.$$

As one can see, neither multiplications nor divisions are necessary for that, and therefore the color depth does not change. The results for C, M, and Y are in each case again within the number range from 0 to 255 and so are each representable by 8 bpc.

This was exemplarily signified in the attached FIG. 2, in which for the color values Red, Green, and Blue as well as for the colors Cyan, Magenta, and Yellow each time data words with 8 bit are designated. Naturally the absolute length of these data words, consequently the color depth, within the scope of the method according to the invention is arbitrary. The method for example is also functioning with a color depth of 16 bpc. Also if coefficients for the print color Black are to be computed, there are appropriate algorithms for the purpose, which however shall not be elaborated at this point.

Figure 1:
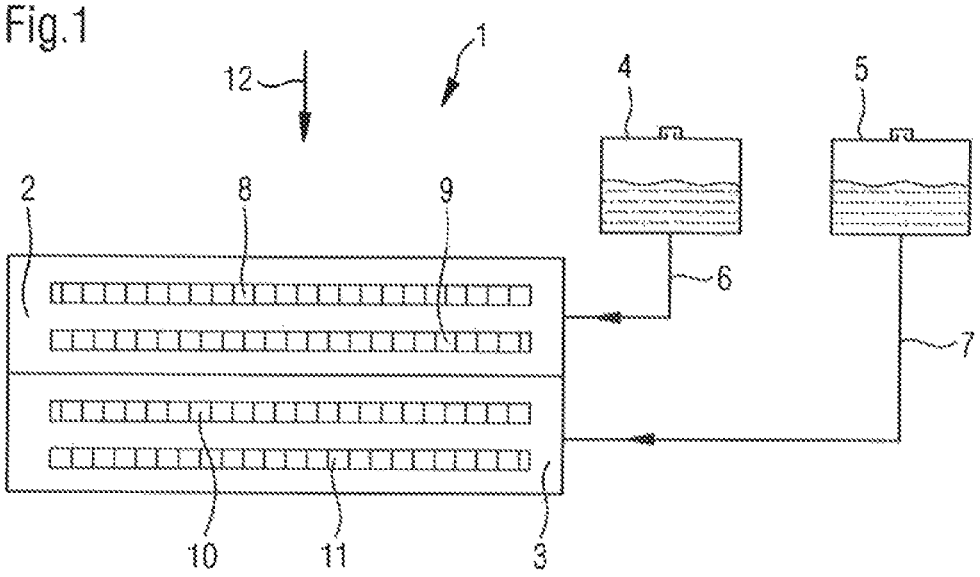
FIG. 1 A schematic representation of the printing units for a single printing color, and FIG. 2 A signal flow chart representing the printing method according to the invention.

The distinctiveness how printing takes place now on the basis of these coefficients suitably computed for these printing colors, shall at first be explained by means of FIG. 1. There the printing unit 1 for one single printing color $D_\mu$ (for example $D_1$=Cyan, $D_2$=Magenta, $D_3$=Yellow, $D_4$=Black) can be seen; such a printing unit 1 exists also in practice for a multicolor printing method several times, for example for four-color printing four times.

The printing unit 1 consists of two print heads 2, 3, which may be built identically; of course both print heads 2, 3 can also be combined into one physical unit. However each of the print heads 2, 3 is supplied with different inks $T_{h,\mu}$ $T_{d,\mu}$ that are placed at disposal in two ink supply tanks 4, 5.

Both inks $T_{h,\mu}$ $T_{d,\mu}$ each contain exactly the same printing color $D_\mu$, but in different color intensities $J_{h,\mu}$, $J_{d,\mu}$; The lighter ink $T_{h,\mu}$, exhibits a lower color intensity $J_{h,\mu}$, the darker ink $T_{d,\mu}$ is of stronger color intensity $J_{d,\mu}$.

As it furthermore appears from FIG. 1, both inks $T_{h,\mu}$, $T_{d,\mu}$ stay strictly separated from each other; coming from the first ink supply tank 4 the lighter ink $T_{h,\mu}$ reaches through a first ink line 6 the first print head 2, while the dark ink $T_{d,\mu}$ flows through a second ink line 7 from the second ink supply tank 5 to the second print head 3.

The representation of the print heads 2, 3 shall be understood as bottom view. There one recognizes twice two rows of individual nozzles 8, 9, 10, 11, whereat the individual nozzles 8, 9, 10, 11 of both rows of a print head 2, 3 each are offset against each other by approximately one half nozzle centerline distance so that, for example, the nozzles 9, 11 of the second (in FIG. 1 each time the lower) row are printing exactly in-between the nozzles 8, 10 of the first (in FIG. 1 each time the upper) row.

The nozzle rows 8 through 11 extend crosswise to the feeding direction 12 of the paper, or crosswise to the relative moving direction of the printing unit 1 relative to the substrate to be imprinted.

At this both print heads 2, 3 are justified in a way so that in feeding direction 12 each nozzle 10, 11 of the second print head 3 is placed exactly behind a nozzle 8, 9 of the first print head 2. In other words to each nozzle 8, 9 of the first print head there is an exactly allocated nozzle 10, 11 of the second print head 3, and the centers of each of the nozzle pairs 8, 10 respectively 9, 11 in that way allocated to one another are each connected with each other by a straight line, which is parallel to the feeding direction 12, and of the same length for all nozzle pairs 8, 10 respectively 9, 11, corresponding to the offset d between both printing units 2, 3.

When like in FIG. 1 both printing units 2, 3 are arranged exactly flush next to each other, such offset d is equivalent to the width b of a print head 2, 3: d=b. However both print heads 2, 3 are normally mounted with a small gap in between to enable some adjustment, Then applies: d>b.

When the paper feed 12 happens at a velocity v, the offset d therefore causes that one and the same pixel on the paper or other substrate reaches print head 3 after print head 2. In the meantime a time interval $\tau$=d/v has passed.

To make sure that in a jointly clocked printing process a pixel of the following printing unit 3 really exactly aligns with a pixel printed by the first printing unit 2 before, furthermore also the offset d between both printing units should conform to a multiple of the size g, respectively of the longitudinal extension, or of the diameter of one pixel: d/g=v, v∈N; otherwise the printing process of both printing units would have to take place phase-delayed.

In any case it is observable that the printing of ink $T_{h,\mu}$ onto one pixel by printing unit 3 takes place delayed by a time interval $\tau$=d/v, referred to the ink $T_{d,\mu}$ printed by printing unit 2 on the very same pixel. For the method according to the invention it is here in the first approximation irrelevant whether at first the lighter ink $T_{h,\mu}$ is printed and then on top of that the darker ink $T_{d,\mu}$, or vice versa.

According to the invention for the color intensities $J_{h,\mu}$, $J_{d,\mu}$ of both inks $T_{h,\mu}$, $T_{d,\mu}$ the following applies:

$$J_{d,\mu}=2^x*J_{h,\mu},$$

which particularly can be achieved by the fact that the dye concentrations $c_{h,\mu}$, $c_{d,\mu}$ in both inks differentiate as follows:

$$c_{d,\mu}=2^x*c_{h,\mu}.$$

At that x is a positive whole number, preferably is x≥2. Therefore the factor $2^x$ can only attain certain discrete values, depending on the selected x, namely 4, 8, 16, 32, etc.

Now preferably x is chosen so that applies: x=b/2, where x does not include any indication of size while b is measured in bpc. This recommendation especially applies when there are only two different inks T per each color D. For more than two inks per printing color two factors $x_1$, $x_2$ have to be determined, from what a greater freedom of design will result.

In the representation according to FIG. 2 is b=8 bpc, thus thereof follows x=4, consequently the following applies for both inks $T_{h,\mu}$, $T_{d,\mu}$:

$$J_{d,\mu}=2^x*J_{h,\mu}=2^4*J_{h,\mu}=16*J_{h,\mu}.$$

In other words, the dye concentrations $c_{h,\mu}$, $c_{d,\mu}$ in both inks should differentiate as follows:

$$c_{d,\mu}=2^x*c_{h,\mu}=2^4*c_{h,\mu}=16*c_{h,\mu}.$$

Assuming for example, the dye contained in ink $T_{h,\mu}$ would be present in a concentration $c_{h,\mu}$ of 0.5 percent by weight, then the dye concentration $c_{d,\mu}$ in the darker ink $T_{d,\mu}$ should be 8 percent by weight so that the following applies: $c_{d,\mu}/c_{h,\mu}=16$.

In order to ensure this the invention recommends to use for the rest of the components of both inks $T_{h,\mu}$, $T_{d,\mu}$ identical compositions. Furthermore the inks $T_{h,\mu}$, $T_{d,\mu}$ also should preferably be kept in closed ink tanks 4, 5 so that perhaps solvent cannot evaporate and thereby change the concentration of dye in the ink uncontrolled. Of course an opening for pressure equalization can nevertheless be in place at the ink supply tanks 4, 5; however these should be as small as possible, perhaps with a diameter of 1 mm or less, for example with a diameter of 0.5 mm or less, preferably with a diameter of 0.2 mm or less, in particular with a diameter of 0.1 mm or less. As the case may be, an opening for pressure equalization could also be closed by a spring-loaded non-return valve, which just opens momentarily to let air in when internally below-atmospheric pressure develops, otherwise however keeps the ink tank closed, while for refilling of the ink tank a cap could be opened, for example by unscrewing it.

Thereby is ensured that at the same medium drop volume of, for example, each time 5 picoliters (pl), always exactly the same quantity of dye is contained in $2^x$ drops of the lighter ink $T_{h,\mu}$, as it is in one drop of the darker ink $T_{d,\mu}$.

Therefore in the case according to FIG. 2 with x=b/2=4, the quantity of dye contained in 16 drops of the lighter ink $T_{h,\mu}$, equals exactly the quantity of dye in one drop of the darker ink $T_{d,\mu}$.

According to FIG. 2 so now the color values 13, 14, 15 for the printing colors $D_1$=Cyan, $D_2$=Magenta, and $D_3$=Yellow, which were derived by a transformation 16 from the color coefficients 17, 18, 19 of the image file for Red, Green, and Blue without notably impairing the color depth in the course of it, i.e. while maintaining the color-related color depth of b bpc, are split up in order to be able to appropriately control each of the print heads 2, 3, allocated to the respective print colors $D_1$, $D_2$, $D_3$.

In the process of it the in each case x lowest value bits are extracted from a color value 13, 14, 15 and are assigned to the print head 2, 3 for the respective lighter ink $T_{h,\mu}$, then the in each case higher value bits are extracted and assigned to the print head 2, 3 for the respective darker ink $T_{h,\mu}$.

In case of only two inks these are in total (b−x) bits; with three inks exhibiting a brightness ratio of $2^2$: $2^{x1}$: 1, $x_1$ bits would be assigned to the brightest ink, $x_2$ bits to the medium-light ink, and $(b-x_1-x_2)$ bits to the darkest ink.

Now when printing of a pixel is pending, the portion of color 20, 21 assigned to an ink—in the present example having a length of von 4 bit—can be queried, if this value 20, 21 is greater than zero.

When that query 22, 23, yields that the respective portion of color 20, 21 equals 1 or is even greater, then in a following process step 24, 25 at first the respective printing unit 2, 3, therefore the respective ink $T_{h,\mu}$, $T_{d,\mu}$ allocated to printing unit 2, 3, is prompted to dispense one drop of the respective ink $T_{h,\mu}$, $T_{d,\mu}$. Following this the respective portion of 20, 21—so for example the value $C_d$ for dark Cyan, or the value $C_h$ for light Cyan, or the value $M_d$ for dark Magenta, or the value $M_h$ for light Magenta or the value $Y_d$ for dark Yellow, or the value $Y_h$ for light Yellow—is decremented by the value 1.

Then query 22, 23 is repeated and only when the new color value 20, 21 is still equal to or greater than 1, again one drop of the respective ink is being printed. This provides for that per pixel altogether only as many drops of an ink are set as it corresponds to the binary number originally stored in the assigned color value 20, 21 or $C_d$, $C_h$, $M_d$, $M_h$, $Y_d$, $Y_h$ respectively.

As an example shall be assumed that for the general Cyan color value 13 of a pixel an 8-bit value of 74 was computed on the basis of the RGB information 17, 18, 19 from the image file, correspondent with the binary number 01001011. That value is split up into x=4 lower value bits 1011 for the lighter ink $T_{h,1}$, and (b−x)=4 higher value bits 0100 for the darker ink $T_{d,1}$.

The binary number 1011 corresponds to the decimal number 11, binary number 0100 corresponds to the decimal number 4. According to this $t_d$=4 drops of the darker ink $T_{d,1}$ are dispensed and $t_h$=11 drops of the lighter ink $T_{h,1}$.

For the Cyan value 13 applies:

$$C=C_d*2^x+C_h,$$

and for the Magenta value 14:

$$M=M_d*2^x+M_h,$$

and for the Yellow value 15:

$$Y=Y_d*2^x+Y_h,$$

and in general for a printing color $D_\mu$:

$$D_\mu=D_{d,\mu}*2^x+D_{h,\mu},$$

where $D_{d,\mu}$ corresponds to the number of drops of the respective darker ink and $D_{h,\mu}$ to the number of drops of the respective lighter ink.

The total dye quantity printed on the pixel concerned is then at a medium drop volume of V for example V=5 pl, and a density p of the ink, for example ρ=1 g/cm$^3$: 11*0.5 percent by weight*V*ρ+4*8 percent by weight V*ρ=(5.5+32) V*ρ=37.5*5 pl*1 g/cm$^3$=187.5*10$^{-12}$*l*1 g/10$^{-3}$ l=187.5*10$^{-9}$ g=0.187 μg.

In the course of this drops of an ink of specified color and intensity are dispensed out of one and the same nozzle 8, 9, 10, 11, in fact one after another at a rapid pace. Such pace is preferably generated in the printing unit itself and depends on the resolution, the feed, and the number of inks of one color. In any case however that pace should be high enough so that the drops dispensed by one single nozzle do not tear apart from each other, but stay connected during their flight to the substrate to be printed on, or even combine even stronger so that on the substrate to be printed on one single "super drop" arrives and there generates only one single ink spot without internal structures, whereby the development of macroscopically discemable (moiré) patterns is avoided also in areas of the same color.

The wave form of drop control should be designed so that in the ideal case $2^x-1$ differently large "super drops" can be generated, perhaps by the aid of a drop size parameterization unit implemented in the printing unit itself, in particular by forwarding of a dual value determining the individual size of the drops, for example in case of a 2-bit drop control (g=2) selected from the dual values 00, 01, 10, 11.

In that case of utilizing a drop size parameterization unit implemented in the printing unit itself the number of Individual drops to be dispensed for the creation of a super drop is less than it would be correspondent to the respective partial color intensity value, and is approximately at a value of $(2^x-1)/(2^g-1)$. With x=4 and g=2 follows from this a value of 15/3=5.

REFERENCE SIGNS

1 Printing unit
2 Print head
3 Print head
4 Ink supply tank
5 Ink supply tank
6 Ink line
7 Ink line
8 Nozzle
9 Nozzle
10 Nozzle
11 Nozzle
12 Feeding direction
13 Color value
14 Color value
15 Color value
16 Transformation
17 Color coefficient
18 Color coefficient
19 Color coefficient
20 Color pigment content
21 Color pigment content

22 Query
23 Query
24 Process step
25 Process step

The invention claimed is:

1. A method of an inkjet printer operation comprising a step of printing out image files of a predetermined color depth of b bpc (bits per color), bN, whereat, as the case may be, the color depth signals specified in an image file are converted from the color system $F_1$, $F_2$, $F_3$, for example Red, Green, Blue, applied there into color depth signals of the printing inks $D_1$, $D_2$, $D_3$, etc., for example Cyan, Magenta, Yellow, as well as Black and/or other colors, where applicable, available there so that in the process the resolution used for color depth of b bpc is surviving in the color depth signal referring to the printing color $D_\mu$, whereat for one or several, in particular all printing colors $D_\mu$, in each case at least two inks $T_{h,\mu}$, $T_{d,\mu}$ of the same color $D_\mu$, but of varying color intensity are used, namely at least one lighter ink $T_{h,\mu}$ of a lighter color intensity $J_{h,\mu}>0$, or even a colorless, brightening ink $T_{f,\mu}$ of a brightening, virtual color intensity $J_{f,\mu}<0$ and at least one darker ink $T_{d,\mu}$ of a darker color intensity $J_{d,\mu}$, where the following applies:

$$J_{d,\mu}-n*J_{h,\mu}=0$$

or:

$$J_{d,\mu}+n*J_{f,\mu}=0$$

with n≥2; and μ=1, 2, 3 . . . ;

and whereat on the area assigned one pixel several drops of the same ink $T_{d,\mu}$, $T_{h,\mu}$, $T_{f,\mu}$ can be printed, namely maximal (n−1) ink drops of the lighter or colorless ink $T_{h,\mu}$, $T_{f,\mu}$, and maximal (m−1) ink drops of the darker ink $T_{d,\mu}$ so that with the darker ink $T_{d,\mu}$ m brightness levels can be accomplished, namely 0 . . . ($m*J_{d,\mu}$), and with the lighter ink $T_{h,\mu}$ n brightness levels, namely 0 . . . ($n*J_{h,\mu}$), what from altogether (n*m) different brightness levels are resulting, namely 0 . . . [$(m-1)*J_{d,\mu}+(n-1)*J_{h,\mu}$)], characterized by the fact, that n∈N, $n=2^x$, so that the following applies:

$$J_{d,\mu}-2^x*J_{h,\mu}=0$$

or:

$$J_{d,\mu}+2^x*J_{f,\mu}=0$$

where x∈N, can be x≥2, for example 2, 3 or 4; then $2^x$ is in these cases $2^2=4$, or $2^3=8$, or $2^4=16$, and whereat the control signals for a printing unit $E_{h,\mu}$ for a lighter or colorless ink $T_{h,\mu}$ are derived from the x lower value bits of the color depth signal referenced to the print colors $D_\mu$ used in such way, that a number of drops of the lighter or colorless ink $T_{h,\mu}$, $T_{f,\mu}$, which is dependent on the value of the binary number in the x lower value bits are shot at frequent intervals in succession, and whereat the control signals for a printing unit $E_{d,\mu}$ for the darker ink $T_{d,\mu}$ are derived from not more than (b−x) higher value bits of the color depth signal referenced to the print colors $D_\mu$, while a number of drops of the darker ink $T_{d,\mu}$ corresponding to the binary number in the not more than (b−x) higher value bits are shot at frequent intervals in succession, however time-delayed by a time interval +T, −T corresponding to the physical distance +d, −d of both printing units $E_{h,\mu}$, $E_{d,\mu}$ in transport direction of the substrate so that the ink drops of the same ink $T_{d,\mu}$, $T_{h,\mu}$, $T_{f,\mu}$ respectively of the same printing color $D_\mu$ can be printed immediately on top of one another.

2. A method according to claim 1, characterized by the fact that n=m, so that altogether $(n*n)=n^2\geq 2^b$ different brightness levels are resulting, namely 0 . . . [$(n-1)*J_{d,\mu}+d_{h,\mu}$)].

3. A method according to claim 2, characterized by the fact that b is even-numbered, therefore b=2*x with x∈N, x≥1, so that with both inks together in total $n^2=2^{2x}$ different color depth or brightness levels are resulting, namely 0 . . . [$(n-1)*(J_{d,\mu}+d_{h,\mu})$].

4. A method according to claim 1, characterized by the fact that on one pixel up to $(2^x-1)$ drops of the same ink can be printed on top of one another so that with the darker ink $2^x$ brightness levels can be achieved, namely 0 . . . $(2^x-1)*J_{d,\mu}$, and with the lighter ink also $2^x$ brightness levels, namely 0 . . . $(2^x-1)*J_{h,\mu}$, what from in total $2^x*2^x=2^{2x}$ different brightness levels are resulting, namely 0 . . . $(2^x-1)*(J_{d,\mu}+J_{h,\mu})$.

5. A method according to claim 1, characterized by the fact that the various color intensity or brightness levels differentiate so that the dye concentrations $C_{h,\mu}$, $C_{d,\mu}$ in the ink fulfill the following equation:

$$c_{d,\mu}=n*c_{h,\mu},$$

or:

$$c_{d,\mu}=2^x*c_{h,\mu}.$$

6. A method according to claim 5, characterized by the fact that the dye in the darker ink chemically conforms to the dye contained in the lighter ink.

7. A method according to claim 1, characterized by the fact that two printing units for printing inks of the same color, but of different color depth or brightness, are triggered time-delayed by a time interval T, whereat preferably the following applies:

$$T=d/v,$$

with v=relative transport velocity of the substrate referencing to the printing unit.

8. A method according to claim 1, characterized by the fact that the volume of a drop is between 0.5 pl and 20 pl, for example between 1 pl and 10 pl, preferably between 2 pl and 8 pl, in particular between 4 pl and 6 pl.

9. A method according to claim 1, characterized by the fact that for generating an inkblot correspondent to the image information for one pixel on the substrate per printing pass and printing color altogether only a number of nozzle openings correspondent to the present color intensities of this printing color are used, of which one is located at the printing unit for a darker ink and another one is located at the printing unit for a lighter ink.

10. A method according to claim 1, characterized by the fact that for generating an inkblot correspondent to the image information for one pixel on the substrate the individual ink drops of the same color and same brightness are printed on top of one another.

11. A method according to claim 10, characterized by the fact that the individual ink drops of the same color and same brightness to be printed on top of one another are dispensed in such quick succession that they unite together during their flight and result in only one single color drop per pixel on the printing substrate.

12. A method according to claim 10, characterized by the fact that the individual ink drops of the same color and same brightness to be printed on top of one another are dispensed in such quick succession that a previous drop has not yet completely come loose from the printing unit, when the following color drop per pixel is already dispensed so that the ink drops do not actually come apart from each other.

13. A method according to claim 1, characterized by the fact that a printing unit is used, which is capable of dispensing ink drops of various sizes, for example coded via a dual value.

14. An inkjet printer for printing out image files with a specified color depth b bpc, bN, in photo quality comprises for one or several in particular all printing colors $D_\mu$, so for example Cyan, Magenta, Yellow, as well as Black, where applicable, a) in each case at least two ink supply tanks (4, 5) are provided for different printing inks $T_{d,\mu}$, $T_{h,\mu}$, $T_{f,\mu}$ of the same color $D_\mu$, but of different color intensity, namely at least one lighter ink $T_{h,\mu}$ of a lighter color intensity $J_{h,\mu}>0$, or even a colorless, brightening ink $T_{f,\mu}$ of a brightening, virtual color intensity $J_{f,\mu}<0$ and at least one darker ink $T_{d,\mu}$ of a darker color intensity $J_{d,\mu}$, where the following applies:

$$J_{d,\mu}-n*J_{h,\mu}=0$$

or:

$$J_{d,\mu}=n*J_{f,\mu}=0$$

with n€N, n≥2; as well as b) in each case two printing units (2, 3) are provided, of which one is supplied from the ink supply tank (5) for the darker ink $T_{d,\mu}$ the other one however from the ink supply tank (4) for the lighter or colorless ink $T_{d,\mu}$, $T_{f,\mu}$, characterized by the fact, that $n=2^x$, so that the following applies:

$$J_{d,\mu}-2^x*J_{h,\mu}=0$$

or:

$$J_{d,\mu}=2^x*J_{f,\mu}=0$$

where x€N, can be x≥2, for example 2, 3 or 4; then $2^x$ is in these cases $2^2=4$, $2^3=8$, or $2^4=16$, and whereat the control signals for a printing unit $E_{h,\mu}$ for a lighter or colorless ink $T_{h,\mu}$ are derived from the x lower value bits of the color depth signal referenced to the print colors $D_\mu$ used in such way, that a number of drops of the lighter or colorless ink $T_{h,\mu}$, $T_{f,\mu}$, which is dependent on the value of the binary number in the x lower value bits are shot at frequent intervals in succession, and whereat the control signals for a printing unit $E_{d,\mu}$ for the darker ink $T_{d,\mu}$ are derived from not more than (b−x) higher value bits of the color depth signal referenced to the print colors $D_\mu$, while a number of drops of the darker ink $T_{d,\mu}$ corresponding to the binary number in the not more than (b−x) higher value bits are shot at frequent intervals in succession, however time-delayed by a time interval +T, −T corresponding to the physical distance +d, −d of both printing units $E_{h,\mu}$, $E_{d,\mu}$ in transport direction of the substrate so that the ink drops of the same ink $T_{d,\mu}$, $T_{h,\mu}$, $T_{f,\mu}$ respectively of the same printing color $D_\mu$ can printed immediately on top of one another and whereat for generating of an inkblot corresponding to the image information for one pixel on the substrate in each case only one single nozzle opening is provided at each printing unit $E_{h,\mu}$, $E_{d,\mu}$.

15. Inkjet printer according to claim 14, characterized by a data splitter that forwards the higher value bits of the color depth signal of a pixel to the printing unit for the darker ink, the lower value bits of the color depth signal of the same pixel however to the printing unit for the lighter ink.

16. Inkjet printer according to claim 15, characterized by a delay module, which is next in line to only one output of the splitter, not however to the other.

17. Inkjet printer according to claim 14, characterized by color depth registers for entering the bits of the color depth signal of a pixel allocated to a printer unit (2, 3).

18. Inkjet printer according to claim 17, characterized by a component that generates each time a pressure pulse within a specified time pattern as long as the value in the color depth register is greater than zero.

19. Inkjet printer according to claim 18, characterized by a component, which each time decrements the value stored in a color depth register by one after a pressure pulse has been generated.

* * * * *